United States Patent [19]

Ballestrazzi et al.

[11] Patent Number: 4,588,180

[45] Date of Patent: May 13, 1986

[54] LOADER FOR SIGNATURES, SHEETS AND SIMILAR PRODUCTS, FOR THE FEEDERS OF PACKAGING MACHINES, BOOKBINDING MACHINES AND THE LIKE

[75] Inventors: Aris Ballestrazzi; Lamberto Tassi, both of Savignano sul Panaro, Italy

[73] Assignee: SITMA Societa Italiana Macchine Automatiche S.p.A., Spilamberto, Italy

[21] Appl. No.: 719,157

[22] Filed: Apr. 2, 1985

[30] Foreign Application Priority Data

Apr. 9, 1984 [IT] Italy ..... 20453 A/84

[51] Int. Cl.[4] ..... B65H 5/22

[52] U.S. Cl. ..... 271/5; 271/20; 271/25; 271/31; 271/31.1; 271/150; 271/155; 271/199; 271/209; 271/221

[58] Field of Search ..... 271/5, 20, 25, 31, 31.1, 271/150, 155, 188, 199, 209, 258, 221, 222

[56] References Cited

U.S. PATENT DOCUMENTS 3,881,719 5/1975 Schmermund ..... 271/150 X 3,945,633 3/1976 Knopp ..... 271/150 X

*Primary Examiner*—Richard A. Schacher

*Attorney, Agent, or Firm*—Fleit, Jacobson, Cohn & Price

[57] ABSTRACT

A loader for box-type feeders of packaging machines, bookbinding machines and the like, in which the products are loaded into a feed channel with an inclined base formed by a conveyor belt, to be brought into contact with a counteracting plate. Sucker arms cyclically withdraw one product at a time and transfer it to wheels provided with grippers which insert the product between pairs of belts by means of which the product is transferred until it discharges into the feeder box. Feeler elements cyclically determine the thrust of the products in the feed channel and enable the conveyor belt to advance through one step when the thrust is smaller than a predetermined value, whereas they prevent said advancement when the thrust is greater than said value.

27 Claims, 10 Drawing Figures

79
139
82
87
104
103
120
95
101
112
119
80
94
111
102
118
140
105

96
IX
119
94
79
87
112
118
120
IX
112
87
79
101
96
102

LOADER FOR SIGNATURES, SHEETS AND SIMILAR PRODUCTS, FOR THE FEEDERS OF PACKAGING MACHINES, BOOKBINDING MACHINES AND THE LIKE

This invention relates to a loader for signatures, sheets and similar products, for the feeders of packaging machines, bookbinding machines and the like.

Packaging, inserting, gathering, metal-stapling and sewing machines etc. receive the products to be handled by way of a collection line on which these products are often formed by building them up from a plurality of individual elementary products. In order to form a periodical or a book, for example, a plurality of so-called signatures is generally required. A "signature" is a printed sheet which has undergone at least one fold (so that four pages are produced), but the trade jargon uses the term "signatures" to also indicate groups of printed sheets which are folded together at least once. It should also be noted that in bookbinding jargon, the term "second-fold" signature" indicates a printed sheet or a group of printed sheets folded once, the term "third-fold signature" indicates a sheet or a group of sheets folded twice (generally with crossing folds), and so on.

The collection line which feeds the bookbinding machine is itself fed by a number of individual feeders equal to the number of signatures or sheets which are to comprise the periodical or book.

Each of these feeders is provided with its own magazine, known as a box, from which suitable members withdraw the relative individual product one at a time, ie a determined signature in the case considered, in order to transfer it to the collection line. Obviously the box of this feeder, which has a rather limited capacity, must be regularly loaded with products in order to ensure constant product availability and prevent stoppages of the bookbinding machine downstream.

Belt loaders for the periodical filling of the boxes of said feeders are already known, comprising a first substantially horizontal conveyor belt on which the products are disposed in a standing position by an operator, followed by a second transfer belt with an upwardly inclined part and a second flat part, on said second belt the products becoming disposed in a scale-like distribution, and from which the products are withdrawn by a pair of rollers in order to be inserted into the box of the feeder served by the loader. The linear speed of the transfer belt is greater than that of the conveyor belt in order to allow the scale-like product distribution to be obtained on the transfer belt automatically.

In this type of belt loader, difficulties are encountered at the moment of withdrawal of the products, ie during their passage from the conveyor belt to the inclined transfer belt. This is because it is very difficult to obtain a regular withdrawal of the individual products by the rising transfer belt and a constant scale-like distribution of the products on this belt, when the loader is to be used for products of different thicknesses and thus of different rigidity and intrinsic consistency, coupled with different surface characteristics such as roughness or smoothness and thus with different degrees of mutual adherence. Thus for example it can happen that the inclined transfer belt sometimes withdraws only one product and other times simultaneously withdraws several products together instead of only one, particularly when handling second-fold signatures (ie printed sheets folded only once) or unfolded single sheets.

Moreover, in the case of second-fold signatures it can happen that sometimes one half of the signature is withdrawn to a greater extent, whereas the other half remains behind with the consequent formation of wrinkles. A further drawback is the obtaining of different degrees of scaling (mutual partial overlap) of the products on the transfer belt, depending on the product thickness and their mutual adherence. Attempts to solve these problems, by making the ratio of conveyor belt speed to transfer belt speed variable and/or by inclining the conveyor belt so that it descends to a greater or lesser degree, and by varying the degree of rise of the transfer belt, have improved the situation but have not completely satisfied all the various requirements which can arise. In particular, it has been found that the aforementioned problems cannot be solved fully satisfactorily with a belt loader of the described type, the operation of which is based on the concept of withdrawing the arriving products on the conveyor belt by virtue of the friction and adherence of the particular product to be withdrawn against the inclined transfer belt. This system can be satisfactorily adjusted for certain types of product to be handled, particularly in the case of third-fold signatures and beyond, but it does not offer sufficient guarantee for the entire range of products with different characteristics which can arise. Consideration has therefore been given to using another known system applied in other fields, which is based on the concept of using oscillating arms provided at their free ends with suckers for withdrawing the individual products and using these sucker arms to transfer the withdrawn products on to a rotating drum where they are temporarily retained by suitable gripper members, to then be inserted between pairs of cooperating belts which travel in mutual contact at the same speed and partially wrap about said drum, said pairs of belts withdrawing from each other at a certain point, at which they finally transfer the products by discharging them into the box of the feeder served by the loader.

This system has proved suitable for solving the problem and satisfying the various requirements, but only if certain special arrangements are used.

Firstly, it has been found that in order for the sucker arms to operate correctly and reliably, the products to be individually withdrawn must present themselves in the withdrawal zone always substantially under a constant thrust, independently of the product characteristics, so that when the sucker arms, which swivel through a predetermined angle between a rest position and a withdrawal position, reach this latter position they graze and lightly rest against the product to be withdrawn, without being subjected by it to any excessive counterpressure.

The present invention therefore proposes a loader for signatures, sheets and similar products, for those feeders of packaging machines, bookbinding machines and the like which comprise a box-type magazine, said loader being characterized by comprising a product feed channel with a descending inclined base formed from at least one conveyor belt guided about a deviation roller at the lower end of the channel, and with lateral containing walls, the products being disposed in said channel transversely in a standing position and in mutual contact, a mechanism for controlling the stepwise advancement of said conveyor belt, a transverse counteracting plate spaced apart from the lower end of the feed channel and having its lower edge raised from the inclined surface of said conveyor belt so as to create a withdrawal zone for the products fed through said channel, a group of arms provided at their free ends with suckers arranged to be put into communication with a suction source, said arms being carried by a rockable transverse shaft, control means for imparting rocking movements to said shaft and for moving the suckers of said arms alternately into the withdrawal zone and into a position removed from said zone, a second transverse shaft parallel to said arm-carrying shaft, said second shaft carrying wheels offset with respect to said arms, gripper members mounted on said wheels and arranged to grip the products transferred by the sucker arms when these are in the position removed from the withdrawal zone, for each of said wheels a first endless belt guided about deviation and tensioning rollers and wrapped about said wheel through an arc of greater than 180°, and a second endless belt guided about deviation and tensioning rollers and wrapped about said wheel over said first belt through an arc of less than 180°, said two belts travelling together in mutual contact from the point in which the second belt wraps over the first about said wheel to a discharge point determined by respective deviation rollers which withdraw them from each other, and cooperating in order to convey the product inserted between them as far as said discharge point, motor means for rotating said second wheel-carrying shaft and for driving the pairs of belts wrapped about said wheels, a mechanism controlled by fixed cams for operating said gripper members during the rotation of the gripper-carrying wheels, feeler elements acting in the product withdrawal zone and mounted to swivel between a position in which they are in contact with the product abutting against said counteracting plate and a position removed from the withdrawal zone, means linked to said sucker arm control means in order to remove said feeler elements from the withdrawal zone when the sucker arms are brought into this zone, and to enable the feeler elements to be moved under the action of elastic means into contact with the product abutting against the counteracting plate when the sucker arms are removed from the withdrawal zone, and a switch operationally associated with said feeler elements and acting on said machanism for controlling the stepwise advancement of the conveyor belt in the feed channel in order, at any given time, to halt the advancement by one step when the feeler elements in the product withdrawal zone detect a thrust determined by the products in the feed channel which exceeds a predetermined value.

With this loader configuration and because of the provision of said feeler elements it has been possible to create in the product withdrawal zone at the end of the feed channel, independently of the nature of the products handled at any given time, the most suitable conditions for ensuring the safe and reliable operation of the sucker arms in that the thrust under which the products are presented in the withdrawal zone is maintained practically constant.

In this respect it has proved advantageous to also provide, in an adjustable position on the lateral containing walls of the product feed channel, projecting elements the purpose of which is to constrict the product passage path to partially absorb the upstream product thrust and considerably reduce the compression between the products which have passed beyond the narrow path.

For this purpose there can be further provided an upper guide acting from above on the products before they reach the transverse counteracting plate in the feed channel. The conveyor belt which forms the downwardly inclined base of the feed channel can be suitably divided into three individual spaced-apart coplanar belts which in the active portion of the channel slide on an inclined sheet metal plate, which plate can at the lower end of the channel comprise projections disposed between the individual belts and projecting beyond the belt deviation roller towards the product withdrawal zone, and these projections can be provided with pins arranged to lightly retain the products and ensure the withdrawal of only one product by the sucker arms. Analogous projections fitted with pins can be provided for the same purpose at the lower ends of the lateral walls of the feed channel.

The suckers are connected to the suction source advantageously by way of a rotary valve mounted on said second wheel-carrying shaft in such a manner that the suction commences an instant before the suckers touch the product to be withdrawn, and the suction terminates an instant before the product rests on the gripper-carrying wheels and is gripped by the gripper members.

According to the type and characteristics of the handled products, it can be advantageous and opportune to give the products increased rigidity slightly before their discharge into the feeder collecting box by forming an arch or rib on them during their advancement towards the discharge point while the products are held by the pairs of belts. For this purpose, there can be provided upstream of the discharge point, and disposed between the pairs of belts, a roller in a plane parallel to the direction of advancement and having its periphery projecting beyond the plane of advancement, this roller possibly being followed by a folder rod adjustable beyond the height of said roller.

The characteristics of the loader according to the invention will be more apparent and complete from the description given hereinafter of one embodiment thereof with reference to the accompanying drawings in which.

Figure 1:
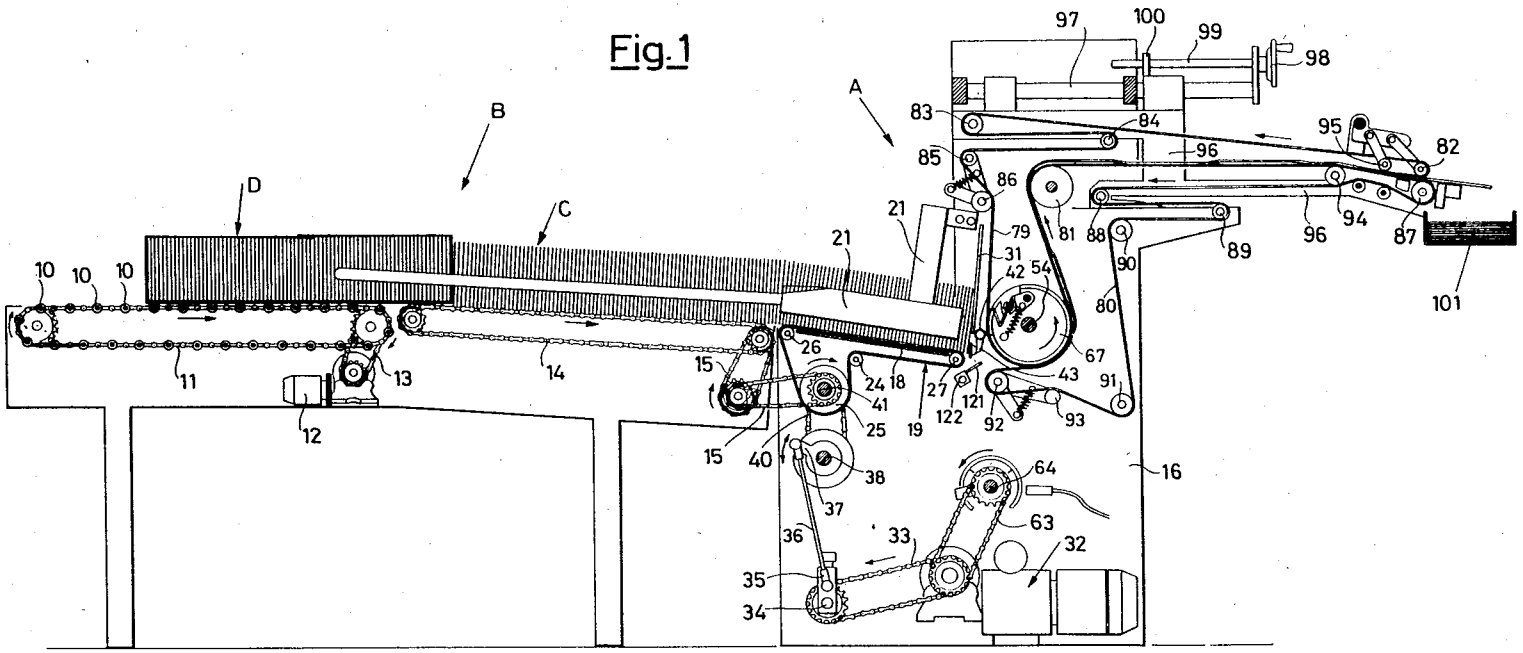
FIG. 1 is a diagrammatic side view of the loader combined with an upstream conveyor.

As can be seen from the drawings, the loader for signatures and similar products is indicated overall by A and can be used either autonomously or, as in the case illustrated in FIG. 1, combined with a conveyor indicated overall by B.

The conveyor B allows the feeding of products, such as signatures, indicated by C, which have been previously stacked and tied into bundles, such as that indicated by D in FIG. 1.

The conveyor B, which does not form part of the present invention, comprises an initial part formed from a roller conveyor in the form of idle rollers 10 carried by chains 11 which advance continuously by virtue of an independent drive provided by a motor 12 and a chain transmission 13, and a final part formed from chains 14 driven by the loader A in such a manner as to advance stepwise, by means of a chain transmission indicated overall by 15, as will be explained hereinafter. It should be noted that an operator deposits bundles of products, such as the bundle D, still in their bound state, onto the initial part of the conveyor B, and these advance until they reset, with constant uniform pressure, against the products disposed on the final part of the conveyor. During the advancement of a bundle of products deposited on the initial part of the conveyor B, the operator removes the binding. The final part of the conveyor B is slightly inclined downwards in order to improve the stability of the products which, in this zone, are already mostly loose. The loader A comprise a frame with two side walls 16, 17 which supports the various component members of the loader.

On the inlet side, the loader A comprises a product feed channel which, if combined with a conveyor B, directly follows this latter at the same height, at the final end thereof. This feed channel, in which the products are disposed transversely in a standing position and in contact with each other, as shown in FIG. 1, is formed from an inclined base plate 18, on which slides the upper portion of a conveyor belt 19, constituted in the illustrated case by three individual coplanar belts 19*a*, 19*b*, 19*c* (see FIG. 2) and two side walls 20 and 21 which can be caused to approach and withdraw from each other by means of a screw-nut mechanism (not shown), by operating a handwheel 22.

Projecting elements 22, 23 are mounted in an adjustable position on the side walls 20, 21, to form a narrow path for the products advancing in the feed channel.

The conveyor belts 19*a*–19*c* are guided over deviation rollers 24, 25, 26 and 27, of which the roller 25 is motorised as described hereinafter, the roller 26 being at the beginning and 27 at the end, ie in a position corresponding with the lower end of the feed channel.

The base plate 18 comprises projections 18*a*, 18*b* (see FIG. 2) which project slightly beyond the deviation roller 27 and are provided with pins 28, which may be adjustable in a manner not shown. The side walls can also comprise prolongations, such as the prolongation 29, provided with pins, such as the pin 30, the purpose of which is described hereinafter.

In front of the lower end of the feed channel and at a short distance therefrom there is disposed a fixed transverse counteracting plate 31, the lower edge of which terminates a certain distance from the running surface of the upper portion of the conveyor belts 19*a*–19*c*, ie is raised above this surface, in order to form a withdrawal zone for the products fed in the channel, the most advanced of which abuts against the counteracting plate 31.

The deviation roller 25 for the conveyor belts 19*a*–19*c* is motorised in the following manner (see FIGS. 1 and 2): by way of a chain 33, a variable speed motor 32 rotates a shaft 34 on which a crank 34 of adjustable eccentricity is mounted and which, by means of a connecting rod 36, acts on a free-wheel device 37 which converts the reciprocating motion of the connecting rod 36 into unilateral half-rotations of the shaft 38 on which the free-wheel device 37 and an electromagnetic coupling 39 are mounted. The driven part of the coupling 39 transmits the unidirectional stepwise motion to the shaft 41 carrying the deviation roller 25, by way of a chain 40.

The speed of the variable speed motor 32 can be varied in order to adapt the operating speed of the loader A to the machine disposed downstream of the loader and to the feeder served by it. Furthermore, by varying the eccentricity of the crank 35 it is possible to vary the stepwise advancement of the conveyor belts 19*a*–19*c*.

The chain transmission 15 for controlling the stepwise advancement of the chains 14 of the conveyor B also commences at the shaft 41 of the deviation roller 25, and the transmission ratio is such that the advancement step of the chains 14 is slightly larger than that of the conveyor belts 19*a*–19*c*.

Figure 3:
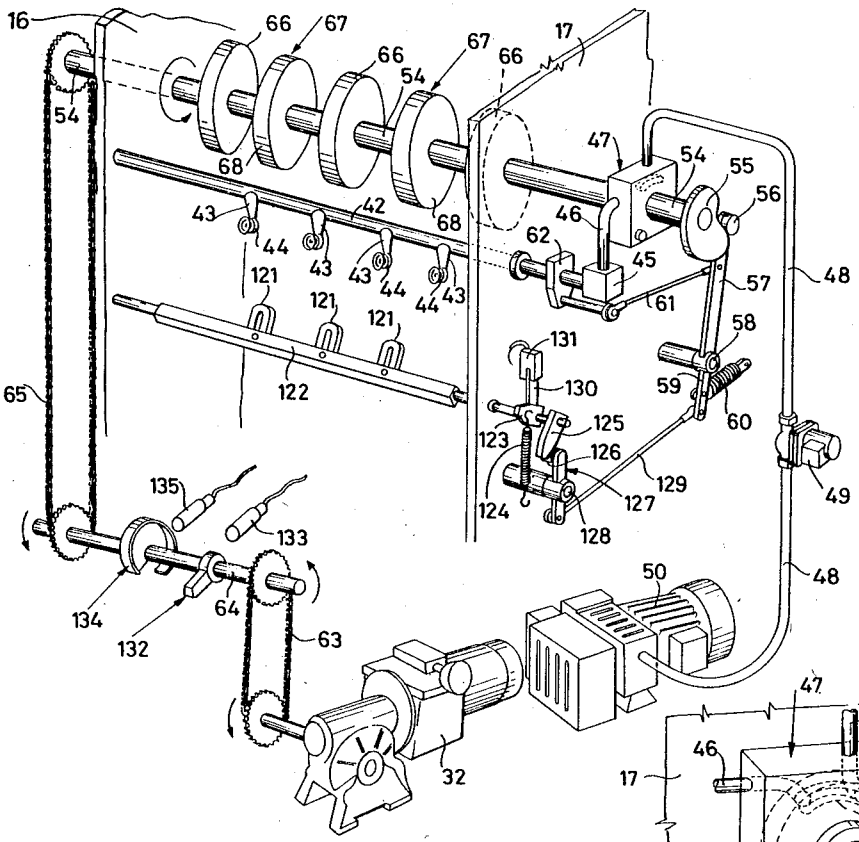
FIG. 3 is a perspective view of a central zone of the loader.

Between the side walls 16, 17 there is rotatably mounted at transverse shaft 42 in close proximity to the withdrawal zone, ie to the lower end of the feed channel, said shaft 42 carrying arms 43 provided at their free ends with suckers 44 (see FIG. 3). Both the shaft 42 and the arms 43 are hollow, to enable the suckers 44 to communicate with a vacuum pump 50 by way of a connector 45, a conduit 46, a rotary valve 47 and a further pipe 48 in which a solenoid valve 49 is connected.

Figure 4:
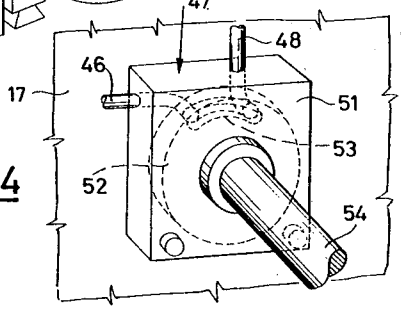
FIGS. 4 and 5 are perspective views of details of the part shown in FIG. 3.

The rotary valve 47 (see FIG. 4) comprises a fixed hollow body 51, in the cavity of which there is rotatable a rotor 52 provided with a slot 53 in the shape of an annular section which is able to connect together, for a determined angle of rotation of the rotor 52, the ports at which the conduits 46 and 48 open into the cavity of the fixed body 51. It is apparent that the vacuum generated by the pump 50 is applied to the suckers 44 for the time during which the rotor 52 connects together the conduits 46 and 48.

The fixed body 51 of the valve 47 is mounted external to the side wall 17, and its rotor 52 is rigid with a shaft 54 mounted rotatably between the two side walls 16 and 17 and traversing the side wall 17, and also traversing the body 51 in a sealed manner.

The transverse shaft 54, the axis of which is parallel to the axis of the arm-carrying shaft 42, carries at its end a cam 55 (see FIG. 3), the contour of which cooperates with a roller 56 carried at the end of an arm 57 of a double arm lever pivoted at 58 to the frame, the other arm 59 of said lever being subjected to the action of a tension spring 60 which keeps the roller 56 adhering to the contour of the cam 55. One end of a rod 61 is connected to the arm 57, its other end being connected to a lever 62 fixed to the end of the arm-carrying shaft 42. By way of the lever system heretofore described, the rotation of the cam 55 therefore causes the shaft 42 and the sucker arms 43 to undergo rocking movements, so that these latter are brought alternately into the product withdrawal zone and into a position removed from said zone.

The shaft 54 is rotated by the variable speed motor 32 by way of a chain 63, an intermediate shaft 64 parallel to the shaft 54 and a chain 65.

Figure 5:
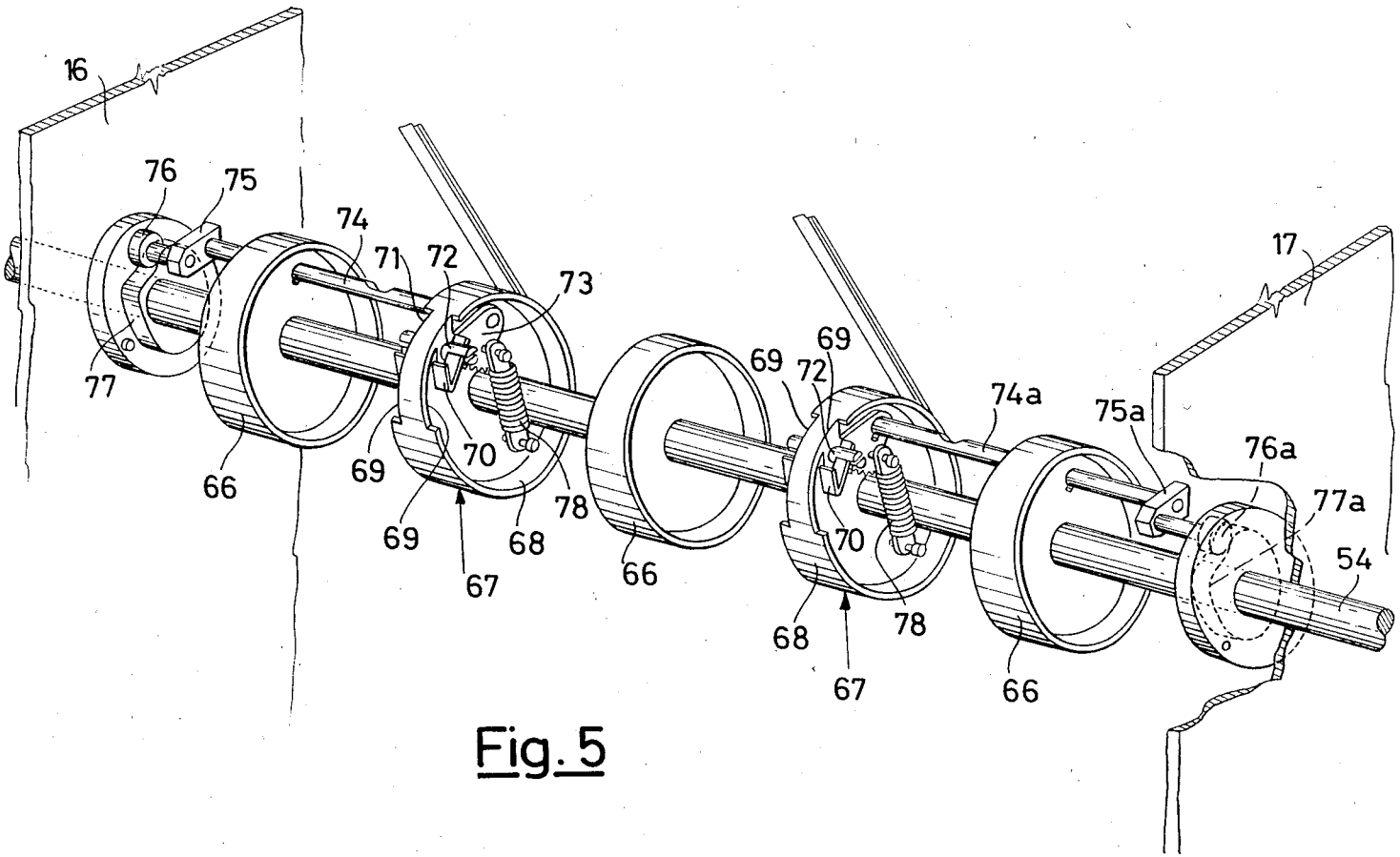
Figure 6:
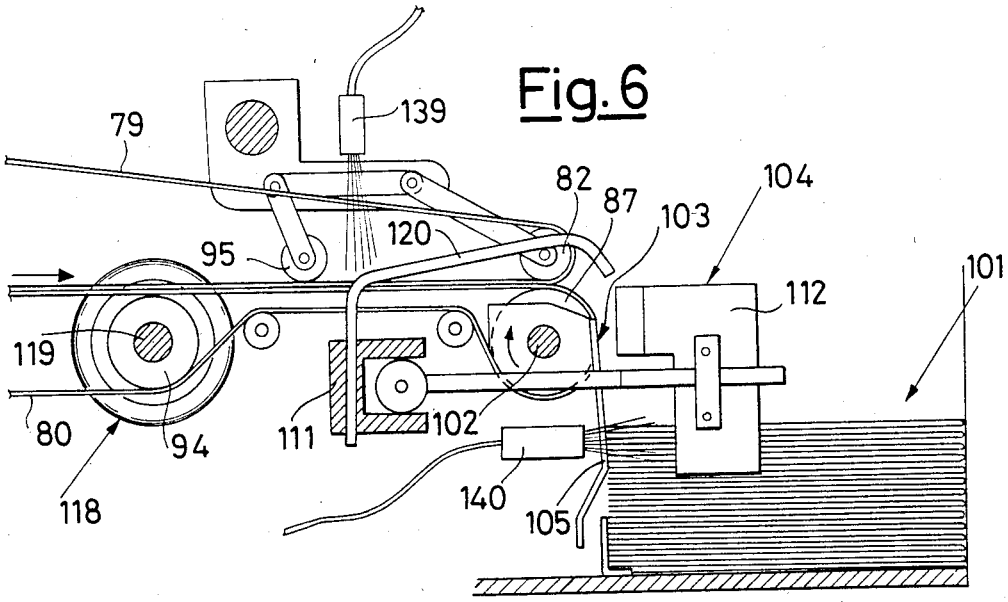
FIGS. 6 and 7 are a side and plan view respectively of the exit part of the loader.
Figure 7:
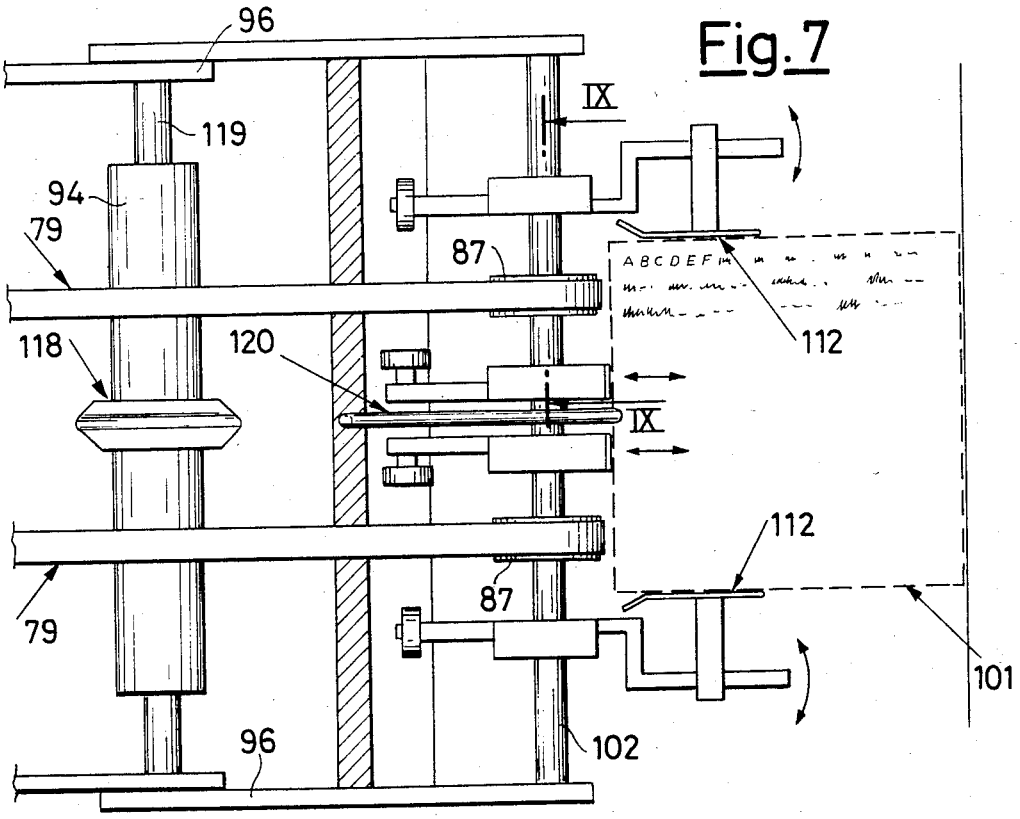
Figure 8:
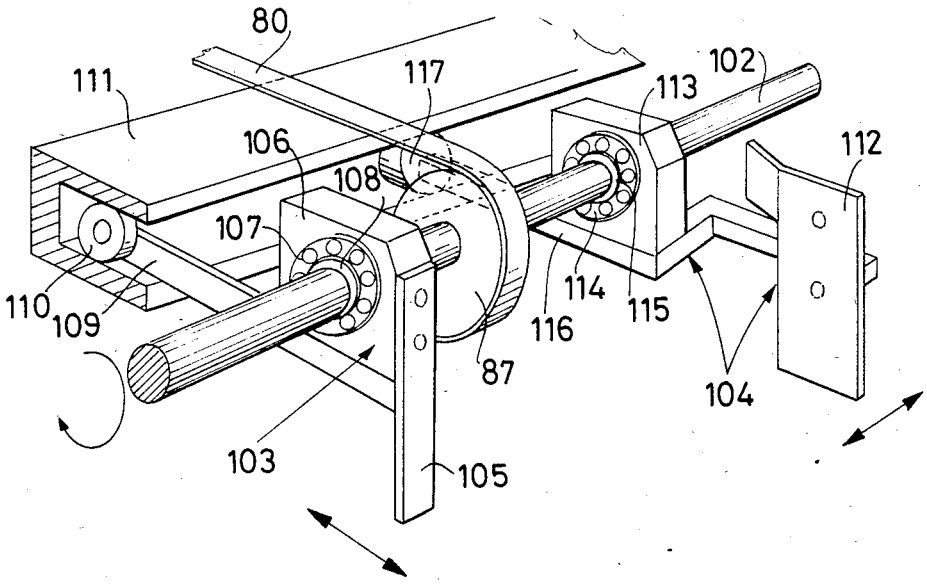
FIGS. 8 and 9 are respectively a diagrammatic perspective view and a diagrammatic section on the line IX—IX of FIG. 7 showing the exit part of the loader.
Figure 9:
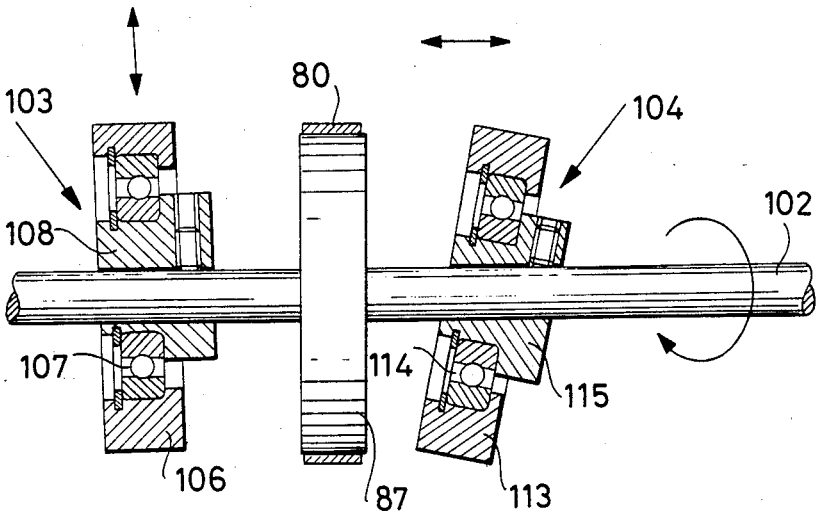
Figure 10:
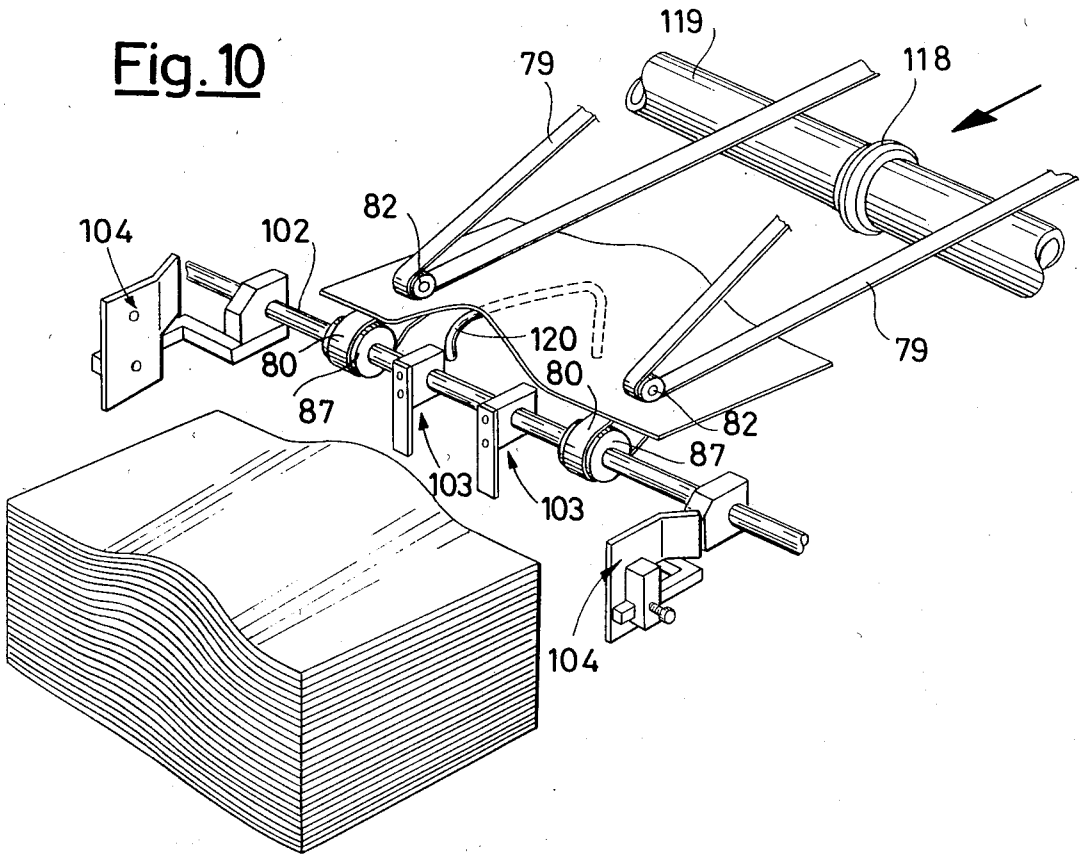
FIG. 10 is a further diagrammatic view of said exit part of the loader.

On the shaft 54, and specifically on that portion thereof between the side walls 16 and 17, there is mounted a series of wheels, as shown particularly in FIG. 5. In particular, three spaced-apart wheels 66 are provided, and a further two special wheels 67 are disposed in the spaces between these three wheels. The wheels 66 are identical to each other, and the wheels 67 are also identical to each other, so that only one of each type will be described. The wheels 67 are gripper-carrying wheels, and their flat based rim 68 comprises through a certain arc on both sides a recess 69 in which a gripper 70 constituted by a lever with a bent end moves, said end being designed to cooperate with the edge 71 of the relative recess 69 of the wheel rim 68. On each wheel 67 there are thus provided two coupled grippers 70 which operate in the side recesses 69 of the wheel rim 68, and are mounted on a common pivot 72 rotatably supported in the wheel disc. The pivot 72 carries a pinion (not shown on the drawing) which engages a toothed sector 73 rigid with a rod 74 which traverses in a freely rotatable manner suitable through holes provided in the discs of the two wheels 67 and 66. At its end, the rod 74, by way of a lever 75, carries a roller 76 cooperating with the outer contour of a cam 77 which surrounds the shaft 54 and which is fixed to the inside of the relative side wall. As clearly visible in FIG. 5, the grippers 70 of that gripper-carrying wheel 67 closer to the side wall 16 are controlled by a cam 77 fixed to this side wall, by means of the roller 76, the lever 75 and the rod 74, whereas the grippers 70 of that gripper-carrying wheel 67 closer to the side wall 17 are controlled by a cam **77*a* fixed to the side wall 17, by way of a roller 76*a*, a lever 75*a* and a rod 74*a*. The two cams 77 and 77*a* are perfectly identical and are disposed symmetrically on the side walls 16 and 17. Springs 78 mounted on the gripper-carrying wheels 67 and acting between the toothed sectors 73 rigid with the rods 74 and 74*a* and the discs of the relative wheels 67 keep the rollers 76 and 76*a* constantly in contact with the contours of the cams 77 and 77*a* during the rotation of the shaft 54 carrying the wheels 66 and 67**.

It should be noted that the arrangement of the wheels 66 and 67 on the shaft 54 relative to the sucker arms 43 on the parallel shaft 42 is such that each arm 43 lies in a plane between two wheels 66 and 67.

It should also be noted that the grippers 70, when in their rest position, have completely withdrawn within the circumference of the rim 68 of the relative wheel, whereas when in their working position they project from said circumference in order to retain the product which has then been transferred by the sucker arms 43, with its end side against the edges 71 of the lateral recesses 69 of the rim 68. The synchronisation of the movement of the grippers 70 relative to the movement of the sucker arms 43 is such that the former grip and lock the product against the wheels 67 when the sucker arms 43 have rested the product against said wheels.

Each of the two gripper-carrying wheels 67 is partly wrapped in the central part of its rim 68 by a pair of belts (see FIG. 1). A first belt 79 wraps the wheel rim through an arc substantially equal to or slightly greater than 180°, and a second belt 80 wraps it through an arc of less than 180°. As shown in FIG. 1, that part of the wheel 67 wrapped by the first belt 79 is substantially that lying below a horizontal plane passing through the axis of the wheel, whereas that part which is also wrapped by the belt 80 is that lying below said horizontal plane towards the right starting from a substantially vertical plane passing through the wheel axis (ie substantially corresponding to an arc of 90°). Between the point in which the first belt 79 begins to wrap around the gripper-carrying wheel 67 and the point in which the second belt 80 also begins to wrap around said wheel, there thus remains a space, corresponding to an arc of about 90°, in which a product which has been rested by the sucker arms 43 against the wheel and then retained there by the grippers 70 can be inserted between the first belt 79 and the second covering belt 80. The two belts 79 and 80 then leave the wheel together and travel together through a certain path of mutual contact, in order to convey the products which are gradually inserted between them.

The pairs of belts 79 and 80 are driven by the respective gripper-carrying wheels 67 so that they travel at the same linear speed in the direction of the arrows indicated in FIG. 1.

The belt 79 is guided about deviation rollers 81, 82, 83, 84 and 85 besides being partially wrapped about the relative wheel 67, and is kept taut by a tensioning roller 86. The second belt 80 is guided about the deviation roller 81 as in the case of the first belt 79, and then about deviation rollers 87, 88, 89, 90, 91 and 92, and is kept taut by a tensioning roller 93. Rollers 94 and 95 are also provided in order to keep the two belts 79 and 80 in mutual contact between the common deviation roller 81 and the respective deviation rollers 82 and 87, from which latter the common path of the two belts 79 and 80 begins to separate.

It should be noted that the terminal part of the pairs of belts 79 and 80 can be lengthened or shortened. For this purpose, the deviation rollers 82 and 83 of the belt 79 and the deviation rollers 87 and 88 of the belt 80 are mounted on a carriage 96 guided in a mobile manner on horizontal columns 97 of the frame, and a handwheel 98 is provided rigid with a screw 99 mounted in a rotatable but nondisplaceable manner, which cooperates with a nut screw provided in a member 100 rigid with the carriage 96. This arrangement allows variation in format of the products to be loaded into the box 101 diagrammatically indicated in FIG. 1, without changing the position either of the box or of the loader A.

The shaft 102 carrying the deviation rollers 87 of the belt 80 also carries both the front and side joggers for the products which are discharged into the box 101 (see FIGS. 6 to 10). Two front joggers 103 and two side joggers 104 are provided, and to which a respectively longitudinal and transverse oscillatory movement is imparted in the following manner.

Each front jogger 103 is constituted by a type of blade 105 fixed to a member 106 mounted by means of a ball bearing 107 on a cam 108 fixed to the shaft 102. The axis of the cam 108 is parallel to the axis of the shaft 102 (see in particular FIGS. 8 and 9). In addition the member 106 carries an arm 109 with a roller 110 guided in a fixed U-shaped section bar 111. The axis of the roller 110 is parallel to the axis of the shaft 102.

Each side jogger 104 is constituted by a blade 112 fixed to a member 113 mounted by a ball bearing 114 on a cam 115 fixed to the shaft 102. The axis of the cam 115 is inclined to the axis of the shaft 102. The member 113 carries and arm 116 with a roller 117 which is also guided in the U-shaped section bar 111, but its axis, in contrast to that of the roller 110, is perpendicular to the axis of the shaft 102. With this arrangement, the rotation of the shaft 102 transmits an eccentric movement to the front joggers 103 and an oscillatory movement to the side joggers 104, these movements being transformed, by virtue of the guide rollers 110 and 117 respectively, into reciprocating longitudinal movements of the front joggers 103 and reciprocating transverse movements of the side joggers 104 respectively. In order to give greater rigidity to the products discharged into the box 101, the terminal part of the loader is provided with a roller 118 mounted on an idle transverse shaft 119 supported in the carriage 96 (the shaft 119 also carries the roller 94). The periphery of the roller 118 projects beyond the conveying plane of the common path of the belts 79 and 80 (see FIG. 6), so that the roller 118 produces a rib on the products during their advancement while held and retained by the two pairs of belts 79 and 80.

If necessary, this rib can be subsequently further accentuated by means of a folder rod 120 (see FIGS. 6 and 10 in particular) mounted in an adjustable position on the U-shaped section bar 111, so as to be able to project beyond the height of the wheel 118, if greater product rigidity is required.

Considering again the central zone of the loader, in which the products arriving from the feed channel are withdrawn and transferred on to the wheels and between the pairs of belts, in order to ensure correct and undisturbed operation of the members provided for this operation, ie the sucker arms 43, the loader is provided with special feeler elements arranged to operate in the withdrawal zone. These feeler elements (see FIG. 1 and particularly FIG. 3) are constituted by arms 121 mounted on a transverse oscillable bar 122 parallel to the shaft 54 and supported between the side walls 16 and 17. The shaft of the bar 122 traverses the side wall 17 and carries, on the outside thereof, a first arm 123 subjected to the action of a spring 124 tending to cause the bar 122 to rotate anticlockwise, and a second arm 125. The second arm 125 is held, under the action of the spring 124, in contact with a roller 126 carried at the end of a double arm lever 127 pivoted at 128 in an intermediate point and connected at its other end by a tie rod 129 to the end of the arm 59 of the double arm lever 57–59. As stated heretofore, the purpose of the double arm lever 57–59 is also to control the periodical rocker movement of the shaft 42 carrying the sucker arms 43, in accordance with the cam 55.

The arrangement is such that when the sucker arms 43 are moved into the withdrawal zone (by means of a clockwise rotation as shown in FIGS. 1 and 3), the feeler arms 121 are made to rotate clockwise out of the withdrawal zone by the action of the lever 127 with the roller 126 against the arm 125 rigid with the bar 122, in opposition to the action of the spring 124. In contrast, when the sucker arms 43 are moved outside the withdrawal zone (by means of anticlockwise rotation), the double arm lever 127 is rotated clockwise to enable the arm 125 and hence the bar 122, under the action of the spring 124, to rotate anticlockwise until the feeler arms 121 rest in the withdrawal zone against the last product C, abutting against the counteracting plate 31, of the line of products located in the feed channel. In this manner, when in the "reading" position, the feeler arms 121 "sense" the thrust of the products in the feed channel. A flap 130 (FIG. 3) is rigid with the bar 122 carrying the feeler arms 121, and is arranged for insertion between a photoelectric cell and a relative light source, which form a unit indicated by 131. When the feeler arms 121 are in a position removed from the withdrawal zone, the flap 130 does not obscure the photoelectric cell. In contrast, when the feeler arms 121 are moved periodically into the reading position in order to sense the thrust of the products in the feed channel, two situations can arise: either the thrust is less than a predetermined value, which signifies that the feed channel contains a quantity of products such as to require an anvancement of the conveyor belt 19 through one step and thus a corresponding advancement of products, in which case the feeler arms 121 assume a position by which the flap 130 obscures the photoelectric cell of the unit 131; or alternatively the thrust is greater than said predetermined value, which signifies that the quantity of products in the feed channel is excessive, so that no advancement of the conveyor belt 19 through one step is required, in which case the feeler arms 121 assume an angular position such that the flap 130 does not obscure the photoelectric cell of the unit 131.

The required stage at which the feeler arms 121 make their reading, by which the signals produced by the obscuring or lack of obscuring of the photoelectric cell of the unit 131 are used in order to either advance the belt 19 or cause it not to advance, is exactly determined by a cam 132 fixed to the intermediate shaft 64 and cooperating with a proximity switch 133.

Figure 2:
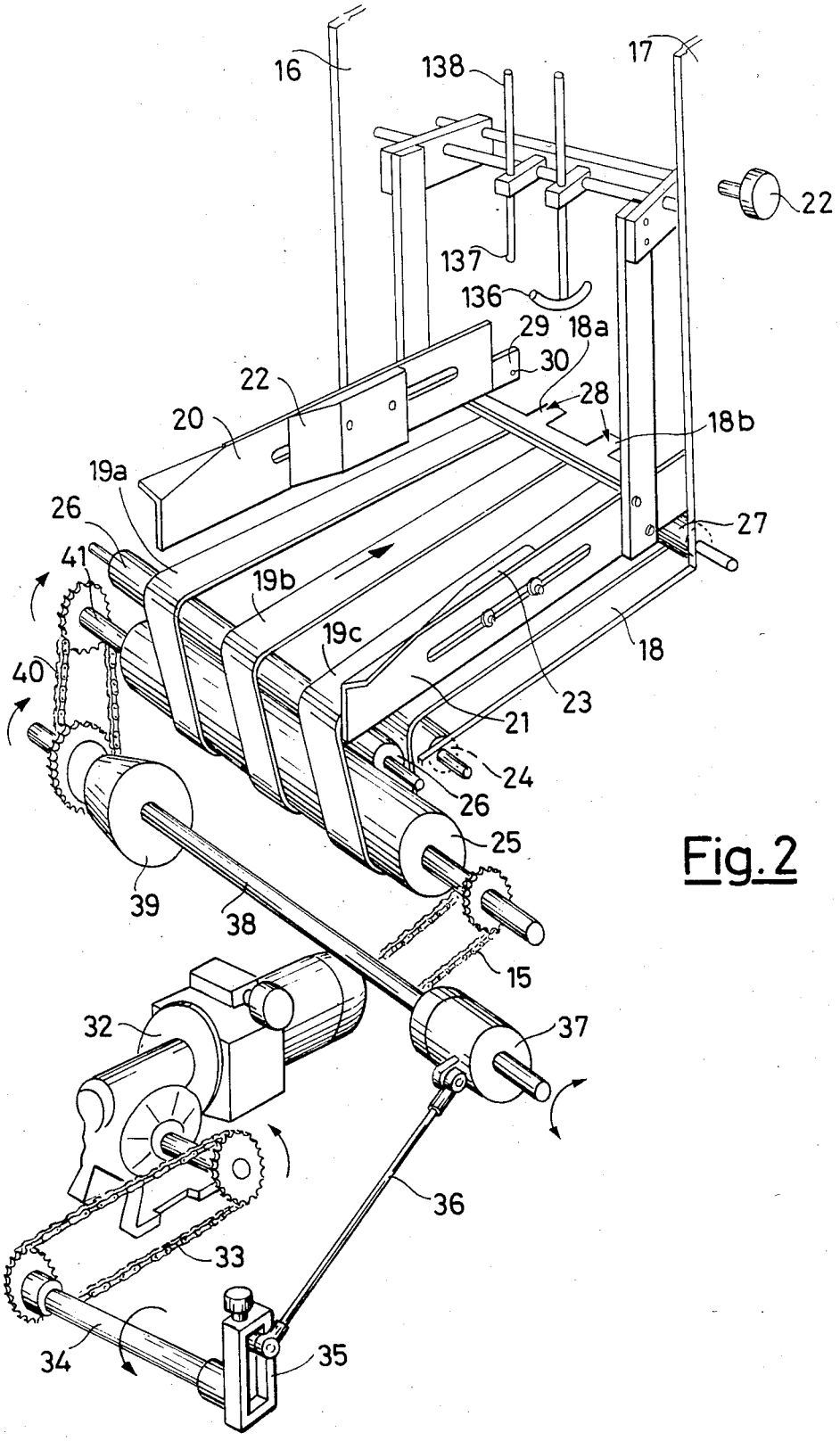
FIG. 2 is a perspective view of the inlet zone of the loader.

It has already been stated that the belt 19 is driven by way of an electromagnetic coupling 39 (FIG. 2). This coupling is normally always engaged in order to allow the stepwise advancement of the conveyor belt 19. It is disengaged only when the feeler arms 121, when in the reading position, detect an excessive thrust, so preventing the photoelectric cell in the unit 131 becoming obscured by the flap during the correct reading phase, as determined by the cam 132 and relative proximity switch 133. In this case, the period of disengagement of the electromagnetic coupling 39 during each working cycle of the loader is determined by a cam 134 which is also fixed to the intermediate shaft 64 and cooperates with a proximity switch 135.

As is apparent from the aforegoing description, the feeler arms 121 therefore have the important purpose of "sensing" and checking, after every cycle involving the withdrawal of a product by the sucker arms 63, the quantity of product present in the feed channel and thus the thrust exerted by these products, in order to determine if the conveyor belt in the feed channel is to be advanced through one step or not.

Thus, independently of the nature, thickness and consistency of the products, this always prevents an excessive thrust on the product which at any given time is to be withdrawn by the sucker arms, and ensures reliable operation of these latter.

As already stated, further special auxiliary arrangements are provided in order to ensure this perfect operation with any type of product. These special arrangements on the one hand involve the projecting elements 22, 23 which are positionable in an adjustable manner on the insides of the side walls 20, 21 of the feed channel, in order to create a constriction in the product passage path, to possibly cause the products to arch and thus considerably reduce the compression between the products along the last portion of the feed channel. This effect can possibly be aided by an upper curved guide 136 (FIG. 2) which can be mounted, in a position adjustable in height, above the terminal part of the feed channel in order to act on the products from above before they reach the counteracting plate 31. The pins 28 and 29 are useful in order to ensure at any given time that only one product is withdrawn by the sucker arms 43. In addition, it is possible to position a pin 137 (FIG. 2) carried by an adjustable rod 138 in front of the counteracting plate 31. Where necessary, this pin prevents the product which has been withdrawn by the sucker arms 43 and transferred to the grippers 70 of the gripper-carrying wheels 67 being dragged behind the next product.

At the discharge end of the loader there is provided a photoelectric cell 139 (FIG. 6), the purpose of which is to check that the discharge of the products into the box 101 is regular. If product build-up occurs in this terminal part of the conveying belts, the photoelectric cell 139 instantly causes stoppage of the loader.

Finally, a further photoelectric cell 140 (FIG. 6) is provided for controlling the quantity of products stacked in the box 101. When the pile of products in the box 101 exceeds a certain level, the photoelectric cell 140 becomes obscured, and causes closure of the solenoid valve 49 in order to prevent vacuum being able to be applied to the suckers 44. As the suction effect of the suckers 44 thus becomes nullified, they are unable to withdraw further products in the withdrawal zone. Consequently, even though all the loader members continue to operate regularly, there is no feed of further products into the box 101. This method of interrupting the loader operation is advantageous in that it prevents the need for frequently halting all its moving members.

The loader according to the present invention has proved suitable for operating fully satisfactorily, without any disturbance, with any type of product, from single sheets with smooth or more or less rought surfaces, to single or multiple second, third or higher-fold signatures.

We claim:

1. A loader for signatures, sheets and similar products, for those feeders of packaging machine, bookbinding machines and the like which comprise a box-type magazine, characterised by comprising a product feed channel with a descending inclined base formed from at least one conveyor belt guided about a deviation roller at the lower end of the channel, and with lateral containing walls, the products being disposed in said channel transversely in a standing position and in mutual contact, a mechanism for controlling the stepwise advancement of said conveyor belt, a transverse counteracting plate spaced apart from the lower end of the feed channel and having its lower edge raised from the inclined surface of said conveyor belt so as to create a withdrawal zone for the products fed through said channel, a group of arms provided at their free ends with suckers arranged to be put into communication with a suction source, said arms being carried by a rockable transverse shaft, control means for imparting rocking movements to said shaft and for moving the suckers of said arms alternately into the withdrawal zone and into a position removed from said zone, a second transverse shaft parallel to said arm-carrying shaft, said second shaft carrying wheels offset with respect to said arms, gripper members mounted on said wheels and arranged to grip the products transferred by the sucker arms when these are in the position removed from the withdrawal zone, for each of said wheels a first endless belt guided about deviation and tensioning rollers and wrapped about said wheel through an arc of greater than 180°, and a second endless belt guided about deviation and tensioning rollers and wrapped about said wheel over said first belt through an arc of less than 180°, said two belts travelling together in mutual contact from the point in which the second belt wraps over the first on said wheel to a discharge point determined by respective deviation rollers which withdraw them from each other, and cooperating in order to convey the product inserted between them as far as said discharge point, motor means for rotating said second wheel-carrying shaft and for driving the pairs of belts wrapped about said wheels, a mechanism controlled by fixed cams for operating said gripper members during the rotation of the gripper-carrying wheels, feeler elements acting in the product withdrawal zone and mounted to swivel between a position in which they are in contact with the product abutting against said counteracting plate and a position removed from the withdrawal zone, means linked to the control means for said sucker arms in order to remove said feeler elements from the withdrawal zone when the sucker arms are moved into this zone, and to enable the feeler elements to be moved under the action of elastic means into contact with the product abutting against the counteracting plate when the sucker arms are removed from the withdrawal zone, and a switch operationally associated with said feeler elements and acting on said mechanism for controlling the stepwise advancement of the conveyor belt in the feed channel in order, at any given time, to halt the advancement through one step when the feeler elements in the product withdrawal zone detect a thrust determined by the products in the feed channel which exceeds a predetermined value.

2. A loader as claimed in claim 1, characterised in that adjustable projecting elements for constricting the product passage path are applied to the insides of the side walls of the feed channel.

3. A loader as claimed in claim 1, characterised in that an adjustable guide is applied above the terminal portion of the feed channel and acts on the products from above.

4. A loader as claimed in claim 1, characterised in that the inclined conveyor belt constituting the base of the feed channel is divided into a plurality of individual spaced-apart coplanar belts.

5. A loader as claimed in claim 4, characterised in that the individual coplanar belts on the base of the feed channel slide on an inclined sheet metal plate.

6. A loader as claimed in claim 5, characterised in that in a position corresponding with the lower end of the channel said inclined plate comprises projections between the individual belts, which extend beyond the belt deviation roller and are provided with upwardly directed retention pins.

7. A loader as claimed in claim 6, characterised in that the feed channel side walls are provided, in a position towards the counteracting plate, with projections fitted with pins directed towards the channel interior.

8. A loader as claimed in claim 1, characterised in that the feeler elements are mounted on a transverse bar subjected to the action of a spring tending to cause said feeler elements to rotate into contact with the product abutting against the counteracting plate, said bar being provided with an arm cooperating with a lever arranged to cause the feeler elements to rotate against the action of said spring under the control of a cam which by means of a further lever also controls the rotation of the shaft carrying the sucker arms.

9. A loader as claimed in claim 8, characterised in that the bar carrying the feeler elements is provided with a flap cooperating with a photoelectric cell arranged to emit signals to an electromagnetic coupling connected into the mechanism for controlling the stepwise advancement of the conveyor belt in the feed channel.

10. A loader as claimed in claim 9, characterised in that the processing of the signals emitted by said photoelectric cell in order to act on said electromagnetic coupling is dependent on a phasing signal emitted by a proximity switch operated by a cam.

11. A loader as claimed in claim 10, characterised in that the electromagnetic coupling is normally in an engaged state, and is disengaged by the signal emitted by the photoelectric cell, and provided that the phasing signal is present, only when the feeler elements detect a thrust determined by the products in the feed channel which exceeds the predetermined value.

12. A loader as claimed in claim 11, characterised in that a cam is provided, acting on a proximity switch in order to determine the period of disengagement of the electromagnetic coupling.

13. A loader as claimed in claim 8, characterised in that said cam is mounted on said second shaft carrying the wheels provided with grippers, said shaft being controlled by a variable speed motor by way of an intermediate shaft, by means of chain transmissions.

14. A loader as claimed in claim 13, characterised in that the intermediate shaft carries the cams cooperating with said proximity switches in order to emit the phasing signal and to determine the period of disengagement of the electromagnetic coupling.

15. A loader as claimed in claim 1, characterised in that the mechanism for controlling the stepwise advancement of the conveyor belt in the feed channel comprises a variable speed motor operating a crank of adjustable eccentricity, a free-wheel device connected to said crank by a connecting rod, and an electromagnetic coupling.

16. A loader as claimed in claim 15, characterised in that said variable speed motor is the same as that used for rotating the shaft on which the gripper-carrying wheels are mounted.

17. A loader as claimed in claim 1, characterised in that said second transverse shaft carries two gripper-carrying wheels mounted spaced-apart between normal wheels, each gripper-carrying wheel being provided with two grippers which are rigid with a common pivot supported in the wheel disc and are disposed to the sides of said disc, said grippers operating in recesses in the wheel rim, the gripper-carrying pivot carrying a pinion engaged with a toothed sector rigid with a control rod rotatably supported by the wheel discs, said rod carrying an arm provided with a roller cooperating with a fixed cam, and elastic means being provided in order to keep said roller in contact with the outline of said cam during the rotation of the shaft which carries said wheels.

18. A loader as claimed in claim 1, characterised in that said second transverse shaft passes through a fixed hollow valve body in a sealed manner, and carries within said body a rotor provided with a slot in the form of an annular sector, there opening into said body a conduit connected to said suckers and a conduit connected to said suction source, the mouths of said conduits being temporarily connected together by said slot during the rotation of said rotor, in said connection conduit there being disposed a solenoid shut-off valve controllable by a photoelectric cell which checks the presence of a determined quantity of products in the box of the feeder served by the loader.

19. A loader as claimed in claim 1, characterised in that two pairs of belts are provided for conveying the products from the gripper-carrying wheels to the position in which the products are discharged into the feeder box, and in that the terminal part of these pairs of belts towards the position of discharge can be lengthened or shortened as the terminal deviation rollers are mounted on a movable carriage.

20. A loader as claimed in claim 1, characterised in that in a position corresponding with the terminal part of the pairs of spaced-apart conveying belts there are provided means which project beyond the conveying level of the products and are inserted between the pairs of belts in order to rib the products.

21. A loader as claimed in claim 20, characterised in that said means comprise a roller disposed parallel to the conveying direction and perpendicular to the conveying level.

22. A loader as claimed in claim 21, characterised in that said means further comprise a folder rod of adjustable height.

23. A loader as claimed in claim 1, characterised in that the terminal part of the pairs of belts which convey the products towards the feeder box is checked for product build-up by a photoelectric cell arranged to stop the loader.

24. A loader as claimed in claim 1, characterised in that an adjustable rod carrying a retention pin is provided at the end of the feed channel, in front of the counteracting plate.

25. A loader as claimed in claim 1, characterised in that the terminal deviation rollers of said second belts of the pairs of conveying belts are mounted on a common shaft, and this common shaft carries, by way of cams, front and side joggers for the products discharged into the feeder box, said joggers forming part of the box walls and being put into a state of vibration by said cams.

26. A loader as claimed in claim 25, characterised in that the front joggers each comprise a blade fixed to a hollow member mounted by way of a ball bearing on the cam fixed to said shaft, the cam axis being parallel to the axis of said shaft, said hollow member being provided with a projecting arm carrying a roller having its axis parallel to the shaft axis, said roller being guided in a U-shaped section bar parallel to said shaft.

27. A loader as claimed in claim 25, characterised in that the side joggers each comprise a blade fixed to a hollow member mounted by way of a ball bearing on the cam fixed to said shaft, the cam axis being inclined to the shaft axis, said hollow member being further provided with a projecting arm carrying a roller having its axis perpendicular to the shaft axis, said roller being guided in a U-shaped section bar parallel to said shaft.

* * * * *